US006167671B1

(12) United States Patent
Wilson

(10) Patent No.: US 6,167,671 B1
(45) Date of Patent: Jan. 2, 2001

(54) PREFABRICATED CONCRETE WALL FORM SYSTEM

(76) Inventor: Steven D. Wilson, 20501 85th Ave., Mediapolis, IA (US) 52637

( * ) Notice: Under 35 U.S.C. 154(b), the term of this patent shall be extended for 0 days.

(21) Appl. No.: 09/216,961

(22) Filed: Dec. 21, 1998

(51) Int. Cl.[7] ..... F04C 2/36; F04B 2/86

(52) U.S. Cl. ..... 52/654.1; 52/293.3; 52/309.15; 52/309.17; 52/426

(58) Field of Search ..... 52/426, 425, 442, 52/424, 654.1, 309.11, 309.15, 309.17, 293.3

(56) References Cited

U.S. PATENT DOCUMENTS

| | | | | |
|---|---|---|---|---|
| 1,083,289 | | 1/1914 | Mason . | |
| 1,183,593 | * | 5/1916 | Robinson | 52/426 |
| 2,741,342 | | 4/1956 | Etten . | |
| 3,258,891 | * | 7/1966 | Haberbosch | 52/654.1 |
| 3,344,571 | * | 10/1967 | Day, Jr. | 52/376 |
| 3,751,867 | | 8/1973 | Layne . | |
| 3,884,646 | | 5/1975 | Kenney . | |
| 3,905,171 | | 9/1975 | Cargill et al. . | |
| 4,530,191 | * | 7/1985 | Boisbluche | 52/654.1 |
| 4,669,234 | | 6/1987 | Wilnau . | |
| 4,706,429 | | 11/1987 | Young . | |
| 4,718,792 | | 1/1988 | Louis . | |
| 4,731,971 | * | 3/1988 | Jerkl | 52/425 |
| 5,040,344 | | 8/1991 | Durand . | |
| 5,308,195 | | 5/1994 | Hotek . | |
| 5,456,554 | | 10/1995 | Barrett et al. . | |
| 5,459,970 | | 10/1995 | Kim . | |
| 5,491,947 | | 2/1996 | Kim . | |
| 5,528,876 | | 6/1996 | Lu . | |
| 5,558,470 | | 9/1996 | Elmore et al. . | |
| 5,657,601 | | 8/1997 | Bean et al. . | |
| 5,927,032 | * | 7/1999 | Record | 52/309.11 |

FOREIGN PATENT DOCUMENTS

| | | | | |
|---|---|---|---|---|
| 382411 | | 9/1964 | (CH) . | |
| 1037105 | | 8/1958 | (DE) . | |
| 2024470 | * | 12/1971 | (DE) | 52/650 |
| 1549859 | | 8/1979 | (GB) . | |

* cited by examiner

*Primary Examiner*—Michael Safavi
(74) *Attorney, Agent, or Firm*—Richard C. Litman

(57) ABSTRACT

A prefabricated concrete wall form system which can be taken to a construction site, joined to other wall forms to form a wall, and filled with concrete. The wall form has an outer wall and an inner wall, each of which can be made from gypsum wall board, plywood sheathing, OSB sheathing, medium density overlay plywood, cement board, rigid foam board, exterior gypsum sheathing, steel siding, steel or aluminum sheet, or fiberglass panels. The outer and inner panels are braced by a series of horizontal, zigzag wires. Vertical wood strips having horizontal grooves corresponding to the wires are used to hold these wires in place. Electrical boxes, plumbing conduits, electrical conduits, doors, windows, and floor joist pockets are made by including a wood mold inside the wall mold, forming the desired hollow structure within the concrete.

17 Claims, 7 Drawing Sheets

PREFABRICATED CONCRETE WALL FORM SYSTEM

BACKGROUND OF THE INVENTION

1. Field of the Invention

The present invention relates to prefabricated concrete wall forms. More specifically, the invention includes a pair of parallel panels joined together by a wire webbing, which serves as a mold for a concrete wall.

2. Description of the Related Art

Although several other inventors have proposed various prefabricated molds for concrete walls, no other inventor within the knowledge of the present inventor has proposed such a mold having the combination of strength and light weight provided by the present invention.

U.S. Pat. No. 1,083,289, issued to Arthur J. Mason on Jan. 6, 1914, describes a method of building concrete dock walls. The method includes sinking heavy reinforced concrete wall sections using the weight of the next section to sink the previous section.

U.S. Pat. No. 2,741,342, issued to Nicholas L. Etten on Apr. 10, 1956, describes a wall construction having opposing metal panels mounted on either side of a frame.

U.S. Pat. No. 3,751,867, issued to Melvin E. Layne on Aug. 14, 1973, describes a concrete-reinforced wall having two parallel sheets separated by metal rods, having metal tabs protruding from the sheets to bear against adjoining panels, and filled with concrete.

U.S. Pat. No. 3,884,646, issued to James T. Kenney on May 20, 1975, describes a structural panel and method of fabrication. The panel comprises a pair of parallel sheets, and a pyramidal, skeletal structure therebetween.

U.S. Pat. No. 3,905,171, issued to Don A. Cargill, Paul M. Corp, and Lloyd M. Forster on Sep. 16, 1975, describes a building panel comprising a pair of parallel plywood panels joined by sheet metal truss stampings. The sheet metal stampings have barbs or prongs to penetrate the panels, securing them together.

U.S. Pat. No. 4,669,234, issued to John A. Wilnau on Jun. 2, 1987, describes a prefabricated wall. The wall sections are made from parallel plywood panels connected by hollow cylindrical spacers. Interior panels define a central section for insulation, and an outer section for concrete. Vertical braces are permanently attached to the outside of the plywood panels, and horizontal braces are temporarily attached during concrete pouring and drying.

U.S. Pat. No. 4,706,429, issued to David A. Young on Nov. 17, 1987, describes an insulating concrete wall forming structure. The outer panels are made from expandable polystyrene (a closed cell, rigid, lightweight cellular plastic having good strength and insulating properties). The parallel panels are held in position relative to each other by a wall tie comprising 20% calcium carbonate filled polypropylene, fitting into T-shaped slots. The top and bottom edges have mating male and female connectors, and the side edges have tongue and groove connectors. Concrete is poured between the two sections. Water pipes and electrical conduits can be placed between the panels before pouring concrete, or placed in cuts in the panels and covered with drywall or plaster.

U.S. Pat. No. 4,718,792, issued to Claude C. Louis on Jan. 12, 1988, describes a prefabricated retaining wall for excavations having corresponding male and female elements along the edges for joining with other wall elements.

U.S. Pat. No. 5,040,344, issued to Philippe Durand on Aug. 20, 1991, describes a prefabricated form for a concrete wall. The form comprises expanded polystyrene or polyurethane panels having horizontal stiffeners. The stiffeners of one panel are connected to the stiffeners of the opposing panel. Vertical supports are removably attached to the outside of the panels.

U.S. Pat. No. 5,308,195, issued to Dan J. Hotek on May 3, 1994, describes a partially prefabricated coping for the top of a cement retaining wall. The coping, which includes a mold, is placed on top of the wall. Cement is poured into the mold, completing the coping. Reinforcement bars project from the retaining wall into the mold.

U.S. Pat. No. 5,456,554, issued to Robert K. Barnett, George Hearn, Henrie Henson, and Michael L. McMullen on Oct. 10, 1995, describes a retaining wall having an anchor attached to a horizontally and vertically flexible C-shaped connector.

U.S. Pat. No. 5,459,970, issued to Chin T. Kim on Oct. 24, 1995, describes a concrete structure and method of manufacture. The structure comprises a pair of parallel concrete panels connected by internal dividing mesh panels. The interior is filled with concrete.

U.S. Pat. No. 5,491,947, issued to Sun Y. Kim on Feb. 20, 1996, describes a concrete wall comprising a pair of outer shells, each formed from plastic panels which lock together. The interior is then filled with concrete. A cross web connects the opposing panels at the location of the locking members joining adjacent panels.

U.S. Pat. No. 5,528,876, issued to Sin-Yuan Lu on Jun. 25, 1996, describes a wall structure comprising a plurality of vertical frames with metal nets welded to the frames. Two opposing frames are connected by zigzag bars welded to the vertical members of the frames. The space between the metal nets is filled with concrete.

U.S. Pat. No. 5,558,470, issued to J. Thomas Elmore, Alan Veatch, William C. Elements, Victor Elias, and Longine J. Wojciechowski on Sep. 24, 1996, describes a method of adjustably anchoring traffic barriers and wall facing panels to the soldier beams of a retaining wall. The method uses U-shaped lugs attached to the wall, connected to stirrup bars attached to the soldier beams. The wall comprises panels having mating lips along the edges. Panels are aligned vertically with each other using plastic dowels extending from the top surface of one panel into cones on the bottom surface of another panel. The wall's reinforcement comprises cast-in-place columns, and hoop-shaped reinforcement members extending from the wall into the traffic barrier.

U.S. Pat. No. 5,657,601, issued to Dennis L. Bean, William Newell Brabston, Philip Garcin Malone, Stafford S. Cooper, and Roger H. Jones, Jr., on Aug. 19, 1997, describes a concrete wall having a pair of fiberglass reinforced cement boards, and a corrugated spacer panel therebetween. Rods perpendicular to the outer panels hold the corrugated spacer panel in the proper position. Dowels parallel to the outer walls provide additional rigidity for the spacer panel.

German Pat. No. 1,037,105, published on Aug. 21, 1958, appears to describe a concrete wall having parallel outer panels around the concrete.

Swiss Pat. No. 382,411, published on Sep. 30, 1964, appears to describe a concrete wall having parallel panels on either side of the concrete, and a framework within the concrete.

Great Britain Pat. No. 1,549,859, published on Aug. 8, 1979, describes a mold for making concrete walls. The mold is made from parallel concrete panels connected by perpendicular concrete braces.

None of the above patents describes a pair of parallel panels connected by the wire webbing proposed by the present inventor. The present inventor's wire webbing provides sufficient reinforcement to the parallel panels forming the mold so that thinner panels may be used than with any other known concrete wall mold.

None of the above inventions and patents, taken either singularly or in combination, is seen to describe the instant invention as claimed. Thus a prefabricated concrete wall form system solving the aforementioned problems is desired.

SUMMARY OF THE INVENTION

The invention is a modular, prefabricated concrete wall form. The basic individual wall form comprises a pair of parallel panels connected by a wire webbing made from horizontally oriented, zigzag wires. The wires are held in place by vertical wood members, each wood member having horizontal channels to secure the wires in place. The wall forms will be joined together and to the floor to form a structure, and then filled with concrete. When the concrete dries, the wall form remains as part of the wall. Metal rods extending from the concrete into the floor or foundation provide additional support. A surface finish or covering can then be applied to the outside of the panels as desired.

The parallel panels forming the outside of the wall form can be made from a wide variety of materials, depending on the purpose of the structure and needs of its ultimate users. Examples of preferred and suggested materials include gypsum wall board, plywood sheathing, OSB sheathing, medium density overlay plywood, cement board, rigid foam board, exterior gypsum sheathing, steel siding, steel or aluminum sheet, or fiberglass panels.

The individual wires run horizontally in an angled zigzag pattern across the width of the wall form. Each wire is patterned or bent to have alternating flat peaks adjoining the wall sections. Each of the vertical wood members has horizontal grooves on its inside surface, which receive the flat peaks. Elongated wood members run vertically across the flat peaks, securing them to the panels. Each of the vertical wood members has horizontal grooves which receive the flat peaks. Additionally, the wall form may include rigid Styrofoam (Polystyrene foam) strips inserted into the wire webbing to provide insulation. These rigid foam strips preferably extend vertically across the flat peaks of the wire, adjacent to one of the two panels.

The individual wall forms are manufactured to include various features desired or required at a specific location within the building structure where the form will be used. For example, a wall form can include electrical boxes, electrical conduits, plumbing, window openings, door openings, joist pockets, etc. These openings are formed by making plywood boxes within the wall form so that concrete does not enter these areas, allowing hollow space for the necessary features.

Although dimensions will vary with individual applications, suggested dimensions are panels four feet wide by eight feet high, the panels spaced four inches apart, and each panel connecting to an individual wire at eight inch centers.

Accordingly, it is a principal object of the invention to provide a wall form for concrete walls achieving the necessary strength with reduced weight as compared to other wall forms.

It is another object of the invention to reduce the cost of constructing a building by providing for prefabricated sections of wall form having the necessary conduits, pockets, and openings built into the form.

It is a further object of the invention to provide a wall form for concrete walls which does not require external bracing.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a prefabricated concrete wall form using a pair of parallel panels joined by a wire webbing. The panels are joined to each other and to a floor or foundation, and filled with concrete to form a structure.

Figure 1:
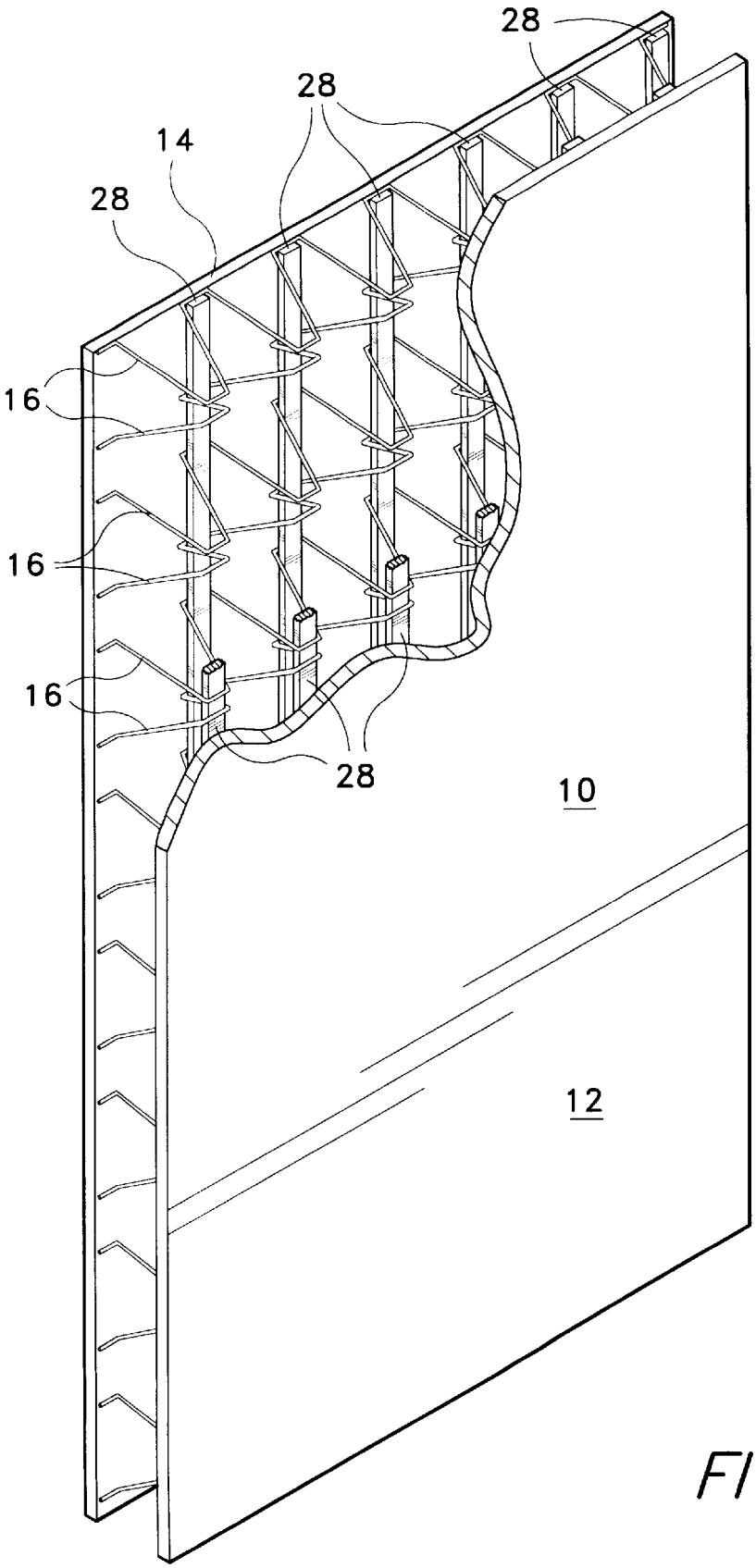
FIG. 1 is cutaway perspective view of a prefabricated concrete wall form system according to the present invention.
Figure 2:
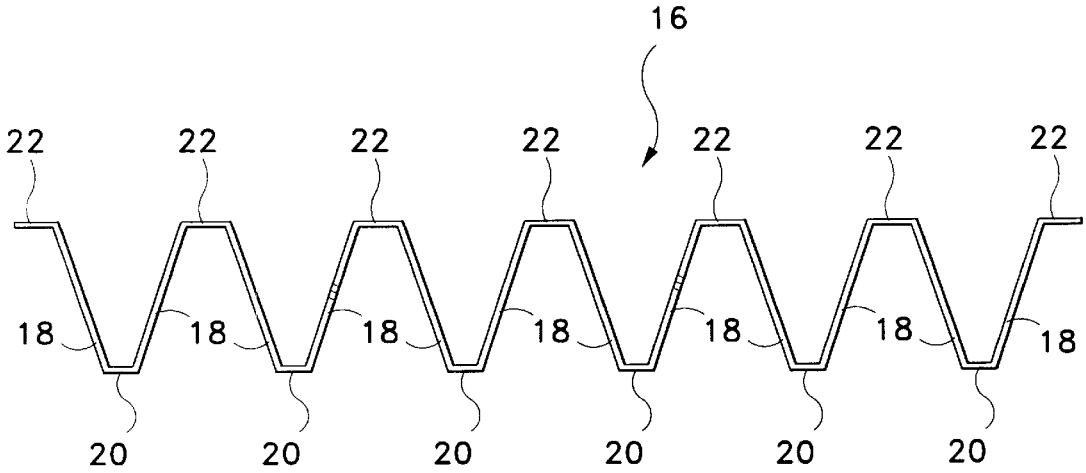
FIG. 2 is a top plan view of a single wire brace used in a prefabricated concrete wall form system of according to the present invention.
Figure 3:
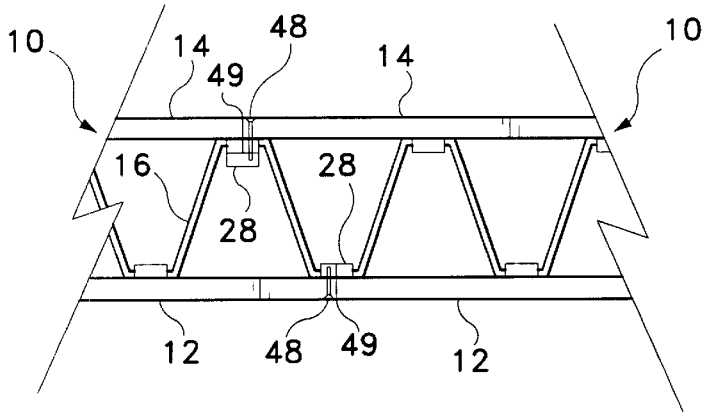
FIG. 3 is a top plan view of a joint between two concrete wall forms according to the present invention.
Figure 10:
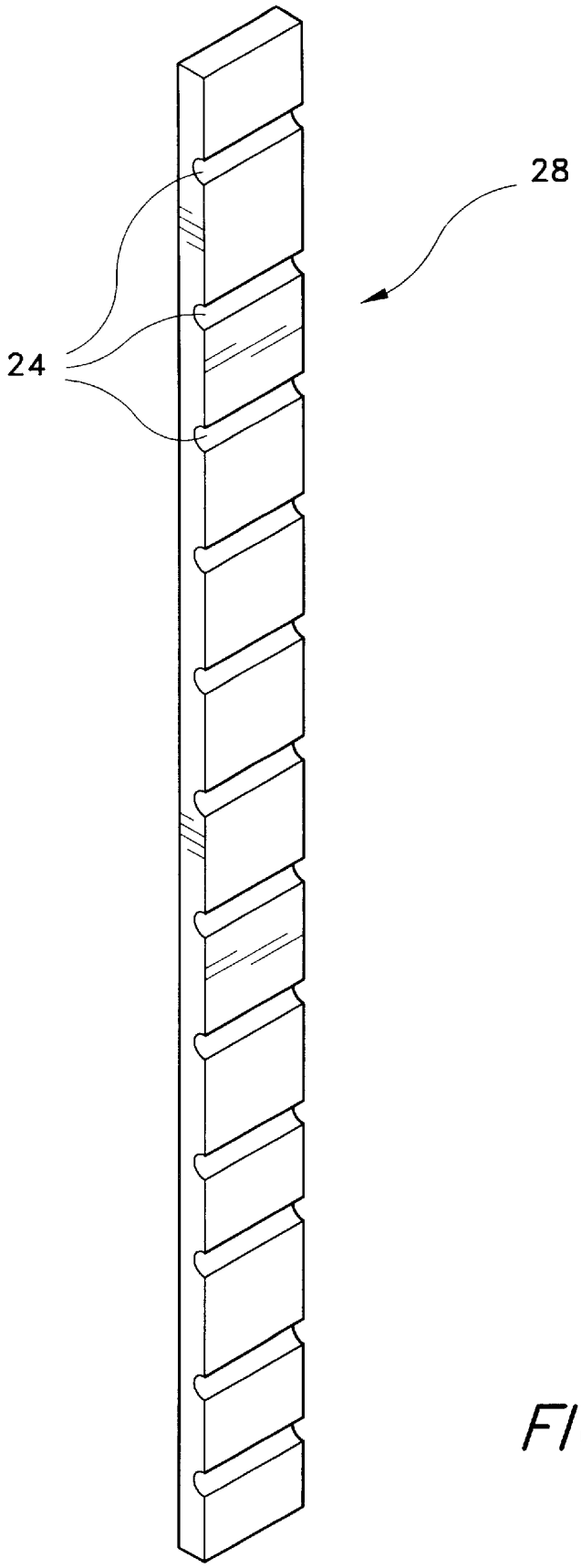
FIG. 10 is an elevational view of a single vertical wood member used to construct a prefabricated concrete wall form system according to the present invention, showing grooves for containing the wire braces.

Referring to FIG. 1, wall form 10 includes panels 12,14, joined by zigzag wires 16. An individual wire 16 is illustrated in FIG. 2. The wire includes angled sections 18, running from one panel to the other, and flat peaks 20,22 on either side of the zigzag structure, for joining with panels 12,14. Each wire 16 runs horizontally across wall form 10, angled so that one set of flat peaks 20,22 is elevated with respect to the other set of flat peaks 20,22. Referring to FIGS. 1 and 3, elongated wood members 28 attach to and extend vertically across inside surfaces 26 of panels 12,14, securing flat peaks 20,22 to the panels 12,14. Referring to FIGS. 1 and 10, elongated wood members 28 define grooves 24, with grooves 24 corresponding in width to the width of wires 16. The flat peaks 20 pass through the channels formed by the grooves 24 of wood members 28, and the inside surface 26 of panels 12,14.

Figure 5:
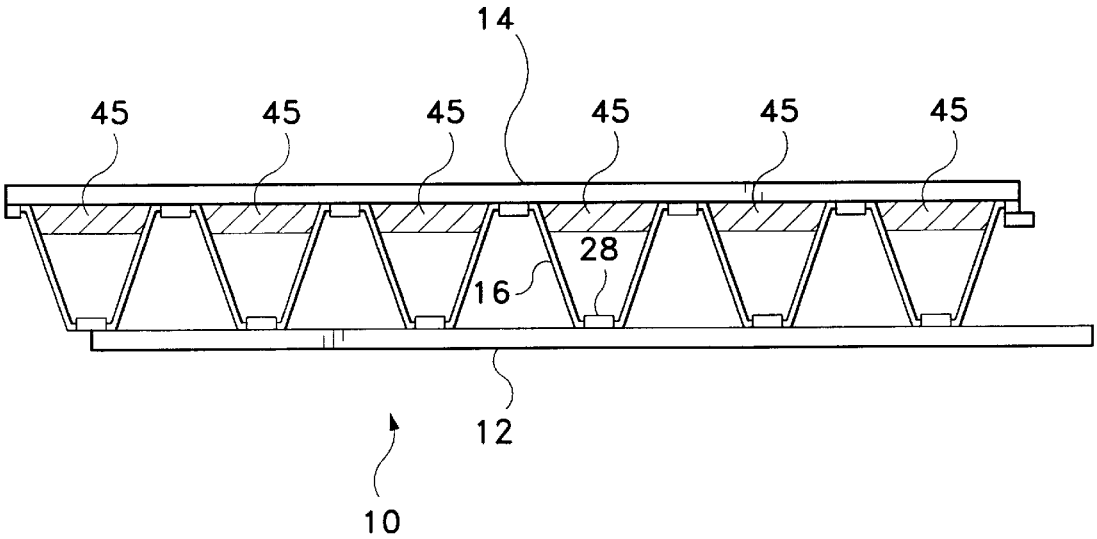
FIG. 5 is a top plan view of a prefabricated concrete wall form system of according to the present invention, showing insulation between the parallel mold panels.
Figure 8:
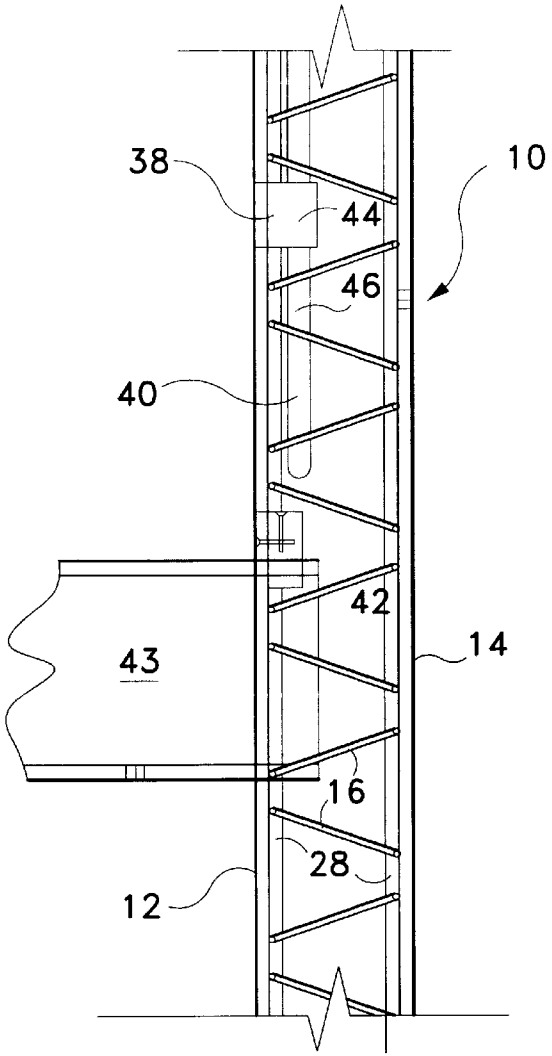
FIG. 8 is a side cross sectional view of a prefabricated concrete wall form system of according to the present invention, showing the joint between the wall and a floor joist, and internal structures to provide for plumbing and electrical wiring.
Figure 7:
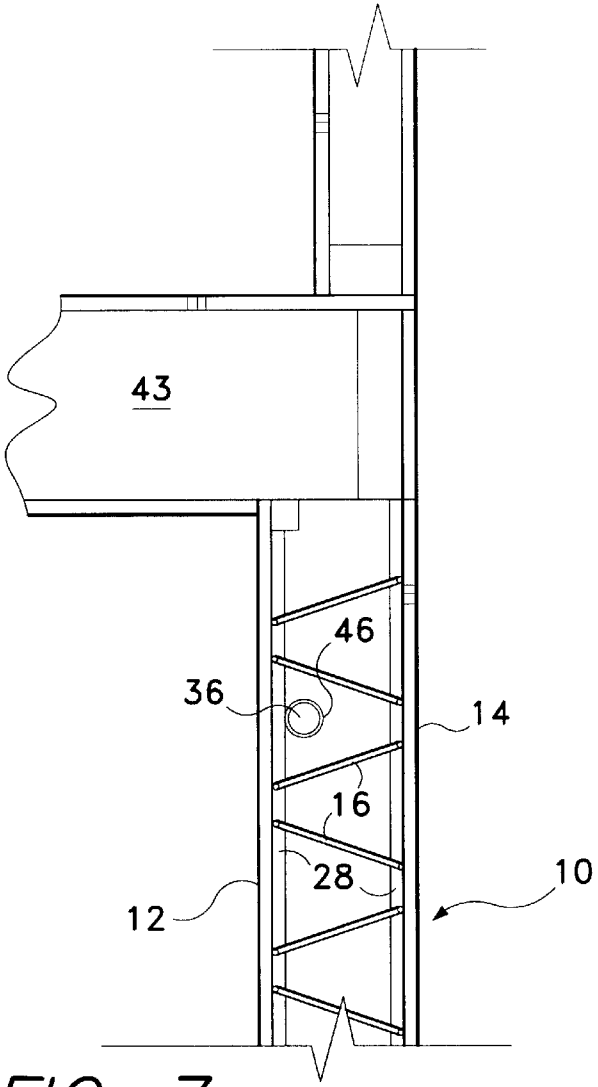
FIG. 7 is a side cross sectional view of a prefabricated concrete wall form system of according to the present invention, showing the joint between the wall and a ceiling, and internal structures to provide for plumbing and electrical wiring.
Figure 9:
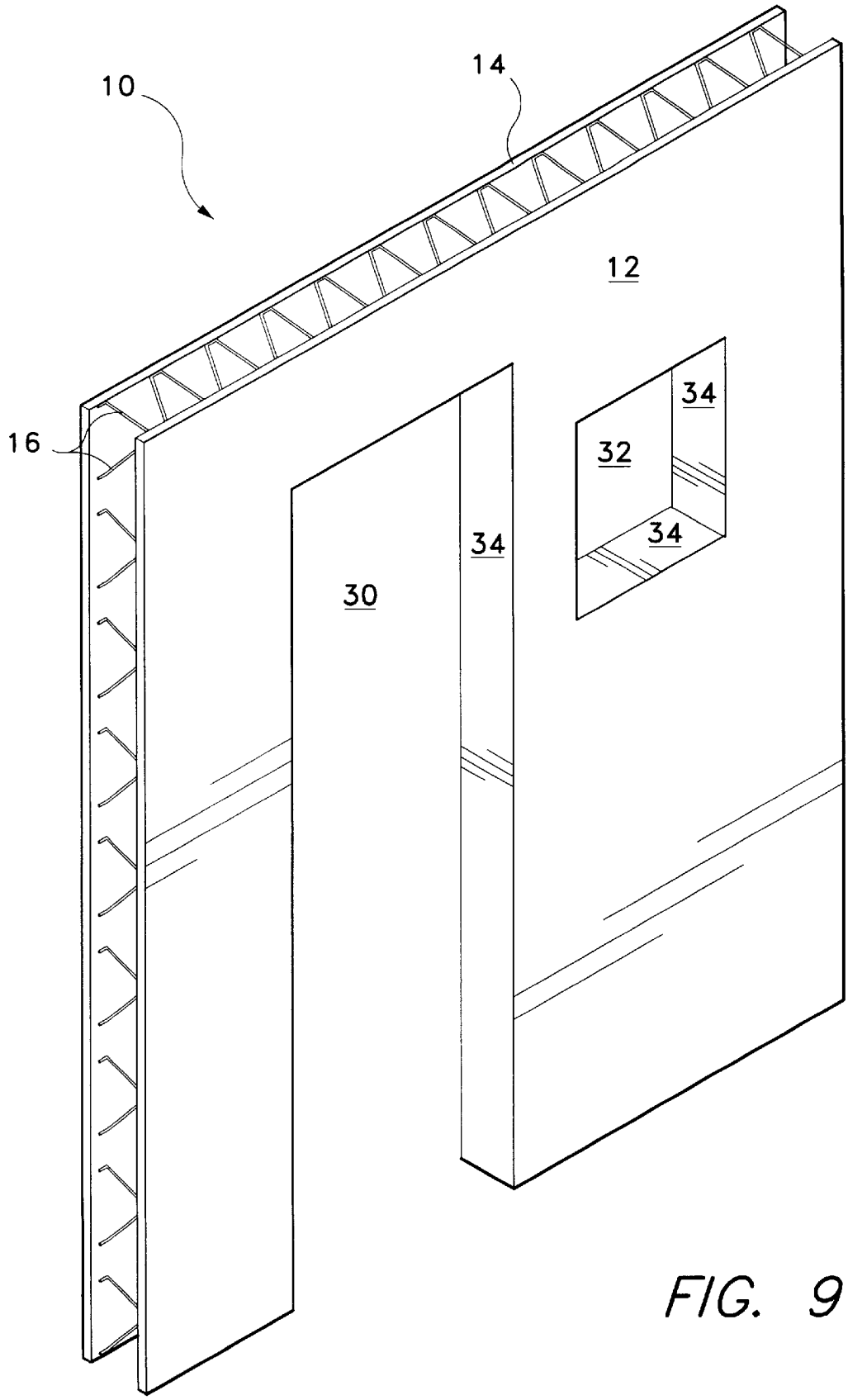
FIG. 9 is perspective view of a prefabricated concrete wall form system according to the present invention, showing door and window openings.

Referring to FIGS. 7, 8, and 9, wall form 10 may include various boxes, conduits, and openings for preventing the flow of concrete into areas of the wall form which must remain open. For example, FIG. 9 illustrates door opening 30 and window opening 32, constructed by cutting the appropriate openings in panels 12,14, and including frame panels 34 to prevent the flow of concrete into door opening 30 or window opening 32. FIG. 7 illustrates plumbing conduit 36, preventing concrete from flowing into the area where plumbing must run. FIG. 8 illustrates electrical box 38, electrical conduit 40, and joist pocket 42. Electrical box 38 and conduit 40 are formed by placing box panels 44 or pipes 46 around the area which must be kept free of concrete. Electrical box 38 and conduit 40 allow for providing electrical wiring within the wall, as is necessary for most buildings. Joist pocket 42 provides a support pocket for ceiling or floor joists 43 after the concrete has been poured and allowed to dry. Alternatively, joist 43 may be attached to the top of wall form 10, as shown in FIG. 7. FIG. 5 illustrates a method of including insulation in the wall form. Rigid Styrofoam (Polystyrene foam) strips 45 extend vertically over flat peaks 20 or 22 of wires 16.

Figure 4:
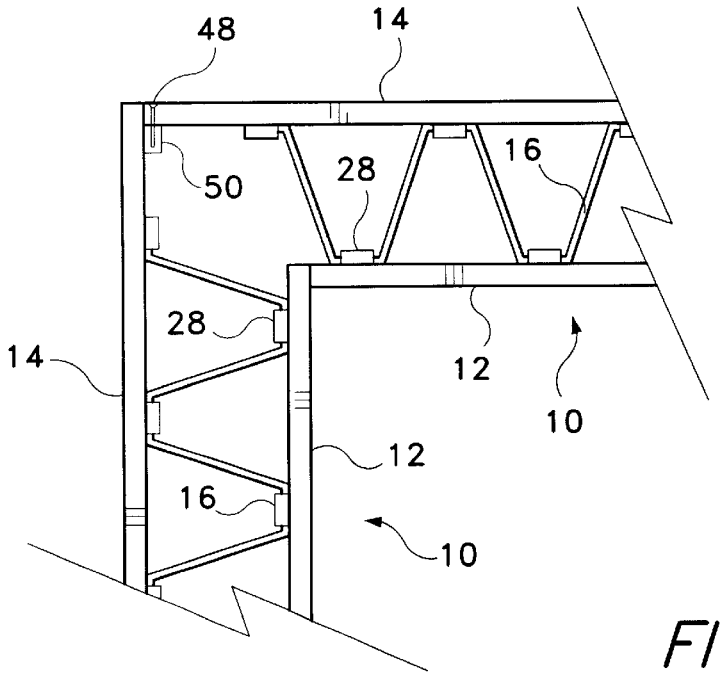
FIG. 4 is a top plan view of a second joint between two concrete wall forms according to the present invention, forming the corner of a building.

At the site where a building is to be built, the wall forms 10 are joined to each other and to the foundation. FIGS. 3 and 4 show alternative methods of joining two wall forms 10 together. Referring to FIG. 3, two wall forms 10 are joined end to end at juncture 49. On one wall form 10, panel 12 extends past panel 14, while on the other wall form 10, panel 14 extends past panel 12. Panel 12 on one wall form 10 abuts panel 12 of the other wall form 10. Similarly, the two panels 14 also abut. The abutting ends are overlapped by elongated wood members 28, with screws 48 passing through panels 12,14 and into elongated members 28. The ends of two wires 16 come together adjacent to the panels 14, with two elongated wood members 28 placed over them to secure them in place.

FIG. 4 illustrates how two wall forms 10 are joined to form a building corner. The ends of both panels 14 are longer than the ends of both panels 12. The ends of panel 12 are positioned abutting each other and perpendicular to each other, and secured in this position. The ends of panel 14 are joined and secured in a similar manner, attached to wood member 50 inside the forms at this joint, preferably by screws 48.

Figure 6B:
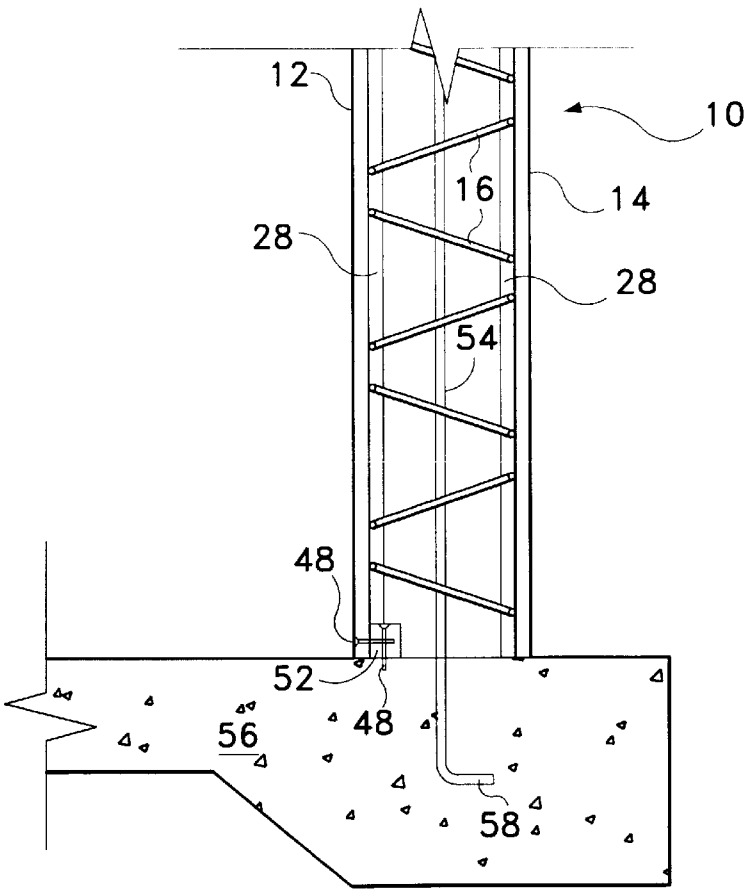
FIG. 6B is a side cross sectional view of a prefabricated concrete wall form system of according to the present invention, showing a second means of securing the wall mold to a foundation.
Figure 6A:
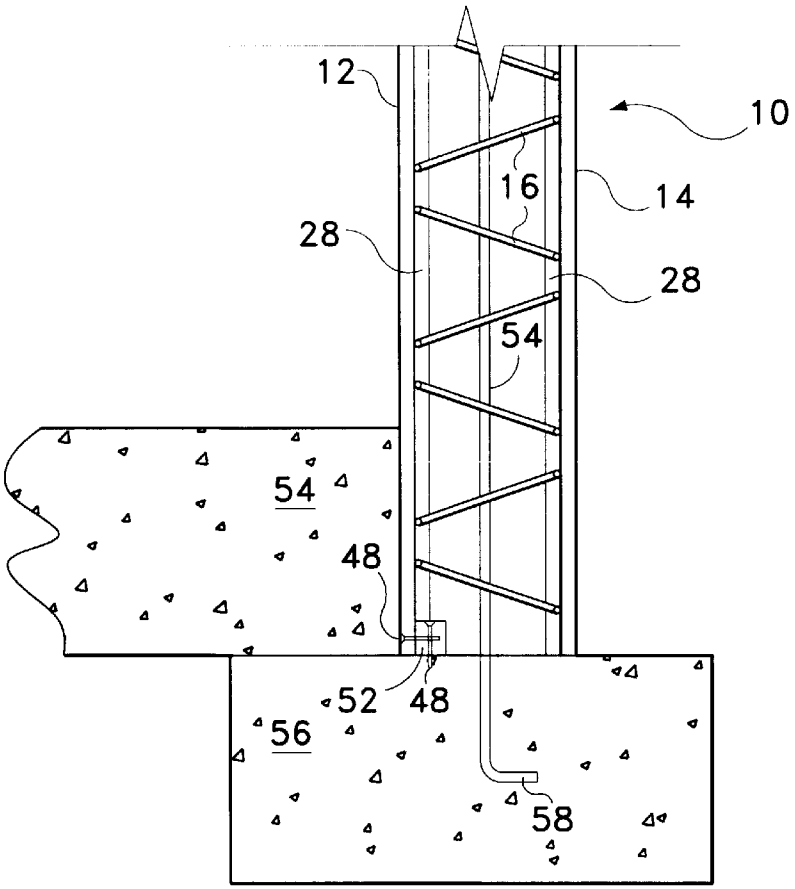
FIG. 6A is a side cross sectional view of a prefabricated concrete wall form system of according to the present invention, showing how the wall mold is secured to a foundation.

FIGS. 6A and 6B illustrate a method of securing wall forms 10 to the foundation 56. Panels 12 or 14 are secured to a wood member 52, preferably a 2"×2" elongated block, which is also secured lengthwise across the foundation 56, preferably by screws 48. Metal rebar 54 extends vertically through wall form 10, extending into foundation 56. Rebar 54 has end 58 within foundation 56, with end 58 being bent to further secure the rebar 54 within foundation 56. End 58 is preferably perpendicular with respect to the rest of rebar 54.

The parallel panels 12,14 can be made from a wide variety of materials, depending on the purpose of the structure and needs of its ultimate users. Examples of preferred and suggested materials include gypsum wall board, plywood sheathing, OSB sheathing, medium density overlay plywood, cement board, rigid foam board, exterior gypsum sheathing, steel siding, steel or aluminum sheet, or fiberglass panels.

To use the invention, the individual wall forms 10 are first constructed at a factory according to the design of the individual building wherein they will be used. Preferred and suggested dimensions for most wall forms 10 are four feet long, eight feet high, four inches thick, and have eight inches between centers for flat peaks 20,22 of wires 16. These dimensions will change for certain panels so that the sum of the lengths of the panels for each wall form is the desired length of the finished wall, and the height of the panels is the desired height of the finished wall. Many of the wall forms 10 will arrive at the construction site having plumbing conduits 36, electrical boxes 38, electrical conduits 40, joist pockets 42, door openings 30, and window openings 32.

Wall forms 10 will then be assembled together at the construction site. Rebars 54 will be placed inside the foundation. Wood members 52 will be attached to foundation 60, and panels 12 or 14 will then be attached to wood members 52. Wall forms 10 will be attached to each other, with panels 12 abutting at their ends, and panels 14 likewise abutting at their ends. Wood members 28 are positioned overlapping the joints between end sections of panels 12 and 14, and screwed into position. When the wall forms 10 are positioned adjacent to each other, they are positioned so that the electrical conduits 40 and plumbing conduits 36 in adjacent wall forms 10 are aligned with each other, and so that door openings 30, window openings 32, electrical boxes 38, and joist pockets 42 are in the locations desired for the completed building. The result is a complete exterior form for the wall to be built.

Concrete is poured into the wall forms, taking up all of the space within the form not occupied by a plumbing conduit 36, electrical box 38, electrical conduit 40, joist pocket 42, door opening 30, and window opening 32. Once the concrete dries, the wall form will remain in place, with panels 12 and 14 forming the exterior panels of the resulting wall. The concrete forming around rebar 54 between panels 12 and 14 will serve to anchor the resulting wall in place.

At this point, the basic wall is complete. Joists may be inserted and attached within joist pockets 42 to form the framework for floors and ceilings. Electrical wiring is installed into electrical boxes 38 and electrical conduits 40. Plumbing is installed into plumbing conduits 36. Doors and windows are installed into door and window openings 30 and 32. Protective and/or decorative coatings are applied to panels 12,14.

It is to be understood that the present invention is not limited to the embodiment described above, but encompasses any and all embodiments within the scope of the following claims.

I claim:

1. A prefabricated wall form for construction of concrete walls, said wall form comprising:

a first and second parallel panel, said panels having a width and a height, said panels having an inside surface, an outside surface, a bottom edge, and a first and second side edge;

a wire webbing between said parallel panels, said wire webbing comprising a plurality of zigzag wires, each wire configured to have angled sections and flat peaks therebetween, said flat peaks being alternately positioned against said first panel and said second panel; and a plurality of elongated members extending across and affixed to said parallel panels' inside surfaces, said elongated members having grooves, said grooves overlapping said flat peaks of said wires.

2. The prefabricated wall form according to claim 1, wherein said wires extend horizontally across said panels.

3. The prefabricated wall form according to claim 2, wherein said flat peaks secured to said first panel are vertically displaced from said flat peaks secured to said second panel.

4. The prefabricated wall form according to claim 2, wherein said elongated members are vertically oriented.

5. The prefabricated wall form according to claim 1, wherein the prefabricated wall form is adapted to use with at least one rebar, the rebar having a vertical section between said first and second parallel panels, and an end section, said end section of the rebar being adapted to extend within and be secured within a foundation.

6. The prefabricated wall form according to claim 1, wherein said wall form defines openings of a type selected from the group consisting of door openings, window openings, electrical box openings, joist pocket openings, electrical conduit openings, and plumbing conduit openings.

7. The prefabricated wall form according to claim 6, wherein said openings are defined by plywood panels within said wall form.

8. The prefabricated wall form according to claim 1, wherein said first and second parallel panels are made from a material selected from the group consisting of gypsum, plywood, OSB, cement, rigid foam, steel, aluminum, and fiberglass.

9. The prefabricated wall form according to claim 1, further comprising blocks having a bottom surface and a side surface, said bottom surface adapted to be attached to the foundation, and said side surface being attached to said bottom edge of one of said panels.

10. The prefabricated wall form according to claim 9, wherein said blocks are two inches wide by two inches high.

11. The prefabricated wall form according to claim 9, wherein said blocks are made from wood.

12. The prefabricated wall form according to claim 1, wherein said flat peaks of said wire adjacent to one of said parallel panels are located at eight inch centers.

13. The prefabricated wall form according to claim 1, wherein said first and second parallel panels are four inches apart.

14. The prefabricated wall form according to claim 1, wherein said first and second parallel panels are four feet long by eight feet high.

15. The prefabricated wall form according to claim 1, further comprising insulation between said parallel panels.

16. The prefabricated wall form according to claim 15, wherein said insulation is rigid Polystyrene.

17. The prefabricated wall form according to claim 15, wherein said insulation is configured as vertical elongated members.

* * * * *